US009981296B2

(12) United States Patent
Schlayer et al.

(10) Patent No.: US 9,981,296 B2
(45) Date of Patent: May 29, 2018

(54) METHOD AND DEVICE FOR PRODUCING AN INTERNALLY AND EXTERNALLY TOOTHED POT-SHAPED SHEET METAL PART USING A FORMING HEAD

(71) Applicant: WEBO Werkzeugbau Oberschwaben GmbH, Amtzell (DE)

(72) Inventors: Dietmar Schlayer, Vogt (DE); Norbert Ziesel, Amtzell (DE)

(73) Assignee: WEBO WERKZEUGBAU OBERSCHWABEN GMBH, Amtzell (DE)

( * ) Notice: Subject to any disclaimer, the term of this patent is extended or adjusted under 35 U.S.C. 154(b) by 362 days.

(21) Appl. No.: 14/640,381

(22) Filed: Mar. 6, 2015

(65) Prior Publication Data

US 2015/0251233 A1 Sep. 10, 2015

(30) Foreign Application Priority Data

Mar. 6, 2014 (DE) ..... 10 2014 002 971

(51) Int. Cl.
*B21B 27/08* (2006.01)
*B21B 1/22* (2006.01)
(Continued)

(52) U.S. Cl.
CPC ..... *B21B 1/227* (2013.01); *B21B 27/005* (2013.01); *B21B 31/02* (2013.01); *B21D 17/04* (2013.01);
(Continued)

(58) Field of Classification Search
CPC ..... B21B 1/227; B21B 27/005; B21B 31/02; B21D 17/04; B21D 53/28; B21H 5/05; B21H 5/025; B21H 5/02; Y10T 29/49471
See application file for complete search history.

(56) References Cited

U.S. PATENT DOCUMENTS 4,470,290 A 9/1984 Jungesjo
5,176,021 A 1/1993 Jensen et al.
(Continued)

FOREIGN PATENT DOCUMENTS

DE 102008038127 B3 2/2010
DE 102010053547 A1 6/2012
(Continued)

OTHER PUBLICATIONS

Machine Translation WO 2009 124534 A2 Oct. 2009 Germany Wittig.*
(Continued)

*Primary Examiner* — David Bryant
*Assistant Examiner* — Lee A Holly
(74) *Attorney, Agent, or Firm* — Browdy and Neimark, PLLC

(57) ABSTRACT

A method for producing an internally and/or externally toothed pot-shaped sheet metal part having teeth extending toward the pot center axis, wherein an un-toothed pot-shaped sheet metal part is inserted into a die and then, by means of a relative movement between the sheet metal part and associated profile rollers, a profile is rolled onto the pot-shaped sheet metal part by the profile rollers applied to the sheet metal part and thus alternating internal and external gear teeth are applied to the sheet metal part, wherein the profile rollers form the sheet metal part oriented radially from the inside toward the outside, in that the profile rollers roll along the inner circumference of the sheet metal part.

16 Claims, 11 Drawing Sheets

Figure 1:
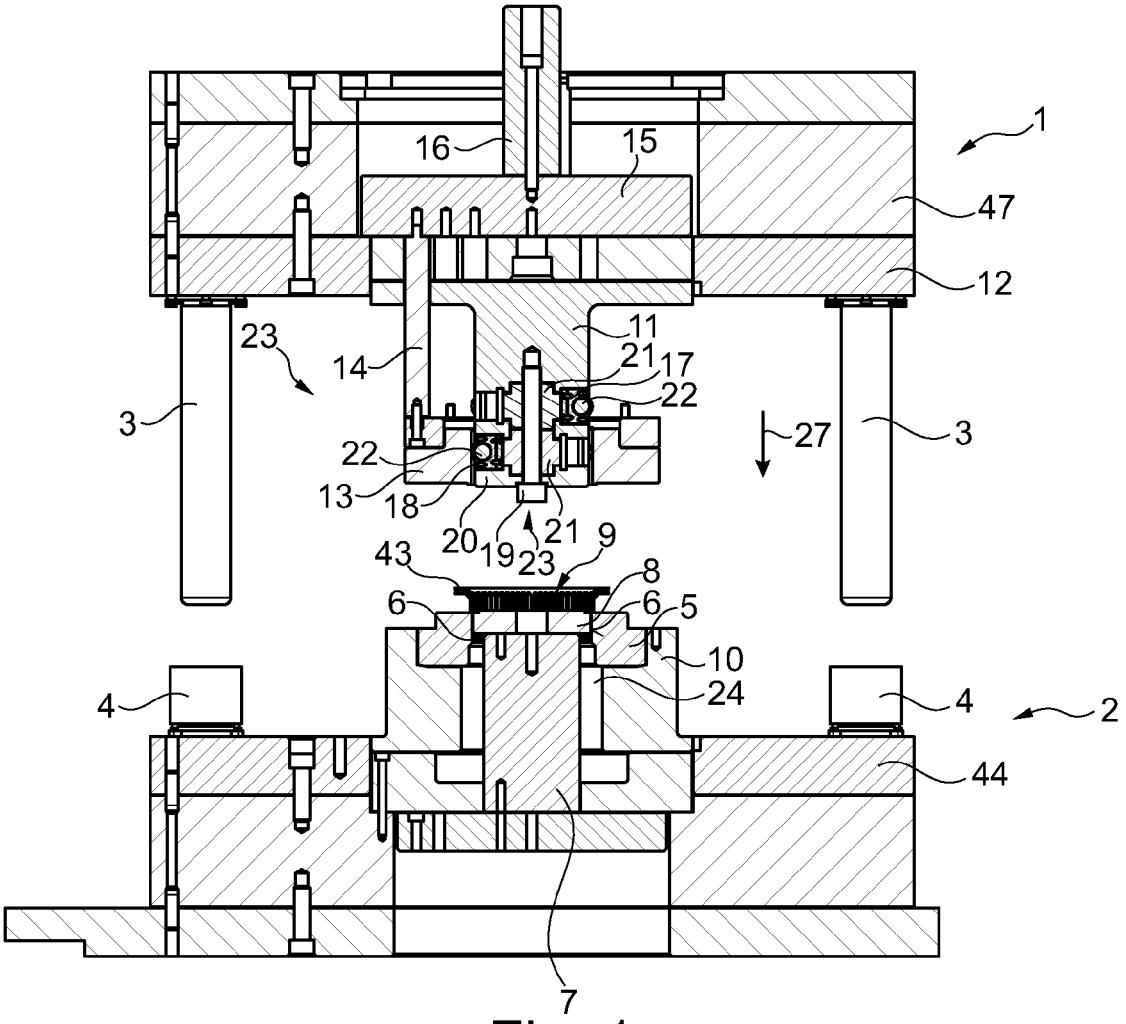

(51) Int. Cl.

| | |
|---|---|
| ***B21D 17/04*** | (2006.01) |
| ***B21D 53/28*** | (2006.01) |
| ***B21H 5/02*** | (2006.01) |
| ***B21B 27/00*** | (2006.01) |
| ***B21B 31/02*** | (2006.01) |

(52) U.S. Cl.
CPC ..... *B21D 53/28* (2013.01); *B21H 5/02* (2013.01); *B21H 5/025* (2013.01); *Y10T 29/49471* (2015.01)

(56) References Cited

U.S. PATENT DOCUMENTS

| | | | | |
|---|---|---|---|---|
| 2011/0079066 | A1 | 4/2011 | Wittig | |
| 2013/0059166 | A1* | 3/2013 | Nagata ..... | B21D 53/28<br>428/600 |
| 2015/0251233 | A1 | 1/2015 | Yedgar | |

FOREIGN PATENT DOCUMENTS

| | | | | |
|---|---|---|---|---|
| DE | 102009044544 | B4 | 3/2013 | |
| EP | 2460599 | A1 | 6/2012 | |
| EP | 2915609 | A1 | 9/2015 | |
| JP | S5841623 | A | 3/1983 | |
| JP | H0839184 | A | 2/1996 | |
| JP | 2003191025 | A | 7/2003 | |
| JP | 2012121068 | A | 6/2012 | |
| WO | WO 9009250 | A1 * | 8/1990 | ..... B21D 53/28 |
| WO | 2009124534 | A2 | 10/2009 | |
| WO | WO 2009124534 | A2 * | 10/2009 | ..... B21D 17/04 |

OTHER PUBLICATIONS

Machine Translation WO 09 09250 A1 Aug. 1990 Germany Gerd.*
European search report, dated Aug. 3, 2015, in corresponding application No. EP15000502.
Canadian Office Action for Canadian Application No. 2,883,980 dated Jan. 30, 2017.

* cited by examiner 9
48,50
49,50

9
49,50
48,50

9
49,50
48,50

METHOD AND DEVICE FOR PRODUCING AN INTERNALLY AND EXTERNALLY TOOTHED POT-SHAPED SHEET METAL PART USING A FORMING HEAD

The invention proceeds from the prior art as is known from WO 2009/12 45 34 A2 and EP 2 460 499 B1.

The invention uses substantially an identical device and an identical method as are described in the two above-mentioned documents. For this reason, reference can be made to the content of the disclosure of the two above-mentioned documents, which is also the subject matter of this invention in its entirety, with regard to the basic functions of the present invention and the device structure.

A disadvantage in the method and the device according to WO 2009/124534 A2 is that the movable forming head, in which cassettes for receiving profile rollers are distributed circularly with the mutual spacing on the circumference, requires a relatively large amount of space. The core of this document is that the forming head is applied from the outside to the sheet metal part to be formed, and as a result the cassettes, in which the profile rollers are arranged, are also applied from the outside to the sheet metal part to be formed and deform the sheet metal part oriented inward in the radial direction. Alternating internal and external gear teeth are thus applied to the sheet metal part, wherein the deformation occurs by way of profile rollers to be applied externally to the sheet metal part.

Such a device and such a method have proven themselves to a large extent. However, it is a disadvantage that sheet metal parts which have a flange oriented outward cannot be provided with gear teeth. Because the known tool having the vertically movable forming head is applied from the outside to the sheet metal part, an outwardly oriented flange on the sheet metal part would make forming no longer possible.

A further disadvantage of the known device is that the forming head requires a lot of space. For this reason, an external roller receptacle must be arranged on the cassettes, which absorbs the pressure, which is oriented radially outward, of the profile rollers on the cassettes. Such a pressure absorbing part or such an absorbing ring is relatively difficult to produce and must be implemented as relatively stable, and requires corresponding installation space.

A further disadvantage is that the known device is restricted to profile rollers as forming bodies.

The object of the invention therefore is that of refining a method and a device for producing an internally and externally toothed pot-shaped sheet metal part so that with less required space and lower production costs of the forming head, sheet metal parts having an outwardly oriented flange can also be formed.

To achieve the stated object, a method according to the subject matter of WO 2009/12 45 34 A2 is characterized in that the forming movement of the forming body is performed in the direction from the radial inside to the radial outside on the sheet metal part.

The essential advantage results in the case of the given technical teaching that now, instead of a deformation pressure and a deformation direction from the outside to the inside, the invention now proposes performing an equivalent deformation oriented from the inside to the outside on the sheet metal part. This means that the forming head is introduced from above into the upper open receptacle of the sheet metal part and provides the sheet metal part with the alternating internal and external gear teeth on the circumference oriented from the inside to the radial outside.

Insofar as the forming head according to the invention operates with profile rollers, it is referred to hereafter as a roller head. However, this name is also maintained if other forming bodies are used instead of the profile rollers, for example, the alternative pressing and drawing forming tool bodies mentioned hereafter.

The term "profile roller" used here in the description of the invention is accordingly not to be understood as restrictive. All forming bodies or drawing or pressing bodies can be used, for example, pressure pieces which operate in the nature of a metal spinning tool or also axle-free rollers, balls, cylinders, pins, and the like.

Particularly in the case of the use of axle-free balls accommodated in the respective cassette (miniroll rolling bodies), the advantage results that multiple such balls (miniroll rolling bodies) can also be accommodated in one cassette. They can be arranged axially aligned one over another or axially aligned offset in relation to one another in the forming direction in the cassette.

However, they can also be mounted in an axle-free manner in a cassette located adjacent to one another in the same plane or located adjacent to one another in various planes.

With the given technical teaching, the essential advantage now results that the forming head must be at least as large in its external circumference as the internal circumference of the sheet metal part to be formed. The necessity results therefrom of producing a forming head having a relatively small structure, which is in turn linked to the advantage that the actual force absorption of the cassettes can now be provided in the center of the forming head, and a stop bushing having relatively small circumference can be arranged there, which absorbs the entire, inwardly oriented forming pressure, which acts on the cassettes.

Instead of a stop ring arranged on the external circumference, as in WO 2009/12 45 34 A2, which must absorb the outwardly oriented forming pressure of the cassettes with a large diameter, instead an internal stop bushing is provided in the center of the forming head of the present invention, which for this reason can be implemented as substantially simpler, more cost-effective, and in a more space-saving manner.

The invention accordingly provides in principle that a forming head extends into a clamped, pot-shaped sheet metal part, and because of the forming bodies rolling along the wall of the sheet metal part on the inner circumference, which are preferably profile rollers, alternating internal and external gear teeth are produced, because the sheet metal part is surrounded on its outer circumference by an associated die provided with complementary gear teeth.

The ring-shaped die accordingly acts with its gear teeth as a support body for applying the gear teeth in the sheet metal part. While the forming bodies operate oriented from the inside to the outside, the die having its complementary gear teeth is applied to the outer side of the sheet metal part The invention is not restricted to a forming head, on which the cassettes having outwardly oriented forming bodies (preferably profile rollers) are arranged and which is introduced into the interior of the sheet metal part to be formed.

In a refinement of the invention, it is provided that a combination of the forming according to WO 2009/12 45 34 A2 and the present invention is proposed as a novel roller head or forming head.

Such a combined roller head or forming head consists of a ring of external cassettes, the forming bodies (preferably profile rollers) of which are oriented radially inward on the outer circumference of the sheet metal part to be formed, and furthermore a further roller head or forming head according to the present invention combined therewith, which is equipped with a number of cassettes arranged distributed uniformly on the circumference, the forming bodies (preferably profile rollers) of which act from the inside toward the outside.

It is therefore possible for the first time using the invention to also form sheet metal parts, which have a stop or parts which protrude beyond the internal circumference of the sheet metal part, using a roller head or forming head which acts from the inside to the outside.

In the prior art, it was always necessary in the case of sheet metal parts, in the case of which a collar or attachments of an large diameter were formed on, to form the collar on the sheet metal part later, after the alternating internal and external gear teeth were applied.

This is no longer necessary according to the present invention, because the collar can be formed on to the unformed pot-shaped sheet metal part, and using this outwardly oriented collar, the unformed sheet metal part can then nonetheless be formed into an internally and externally toothed pot-shaped sheet metal part.

The quality of the part is therefore substantially improved, because a subsequent application of a collar by a separate forming operation can be omitted. During such a preceding forming operation, the precision of the later gear teeth can be impaired.

In a refinement of the present invention, it is moreover also provided that a stripper which is movable separately from the forming head (preferably roller head) is arranged on the upper tool of the device. This stripper ensures the ejection of the sheet metal part after completed forming operation.

In the following description of the drawings, a set of forming bodies (roller set), which is not adjustable during the forming operation, is described, which is characterized in that the cassettes accommodating the forming bodies (the profile rollers) press against linear, cylindrical guide surfaces on the inner stop bushing and therefore are not radially adjustable during the forming operation.

In this case, the invention is not restricted to cassettes which are only arranged in one plane on the forming head (roller head), a combination of multiple cassettes located one above another is also possible to carry out the forming according to the invention.

Such combinations of multiple cassette rings are used to implement different processing steps, for example, post-processing of the applied gear teeth using a further set of profile rollers.

In an alternative embodiment to the above-mentioned exemplary embodiment, a radial adjustment of the forming bodies (profile rollers) in the direction toward the workpiece to be formed is performed in such a manner that, for example, the back plates, which are supported on the tool-side stop bushing, of all cassettes seated on the ring, having a thickness X1 are each replaced by a back plate having a different thickness X2 and therefore the cassettes protrude radially outward more overall than in comparison with thinner back plates, which ensure that the cassettes protrude with a smaller amount radially out of the forming head (roller head).

Accordingly, the depth of the forming of the gear teeth can be adjustable by replacement of the respective back plate on the respective cassette.

In a third embodiment of the invention, it is provided that the back plates of the cassettes do not press against guide surfaces, which are cylindrical and aligned in parallel to the movement direction of the forming head (roller head), on the tool-side stop bushing, but rather that the guide surfaces are aligned at a conical angle in the direction toward the working direction of the forming head (roller head).

In this embodiment, it is possible to perform a radial adjustment of the cassettes during the downward stroke, in that using a suitable pressure ring, which is driven so it is displaceable in the axial direction, the cassettes on their conically beveled back plates are moved on guide surfaces of the stop bushing, which are also conically beveled, and therefore a continuous or also step-by-step adjustment of the radio forming depth of the cassettes is provided during the forming operation.

In a third embodiment, it can also be provided that the cassettes are not aligned in the radial direction oriented precisely from the inside to the outside, and accordingly the profile rollers also operate on a radius beam, but rather they are installed from an angle position deviating from a radius beam in the cassette or the cassette is seated in a deviating angle beam on the stop bushing, as described, for example, in DE 10 2010 053 547 A1.

The invention thus provides a device and a method, in which it is provided in a refinement that the profile rollers or forming bodies do not operate on a radius beam, but rather offset at an angle to the radius beam.

Figure 5:
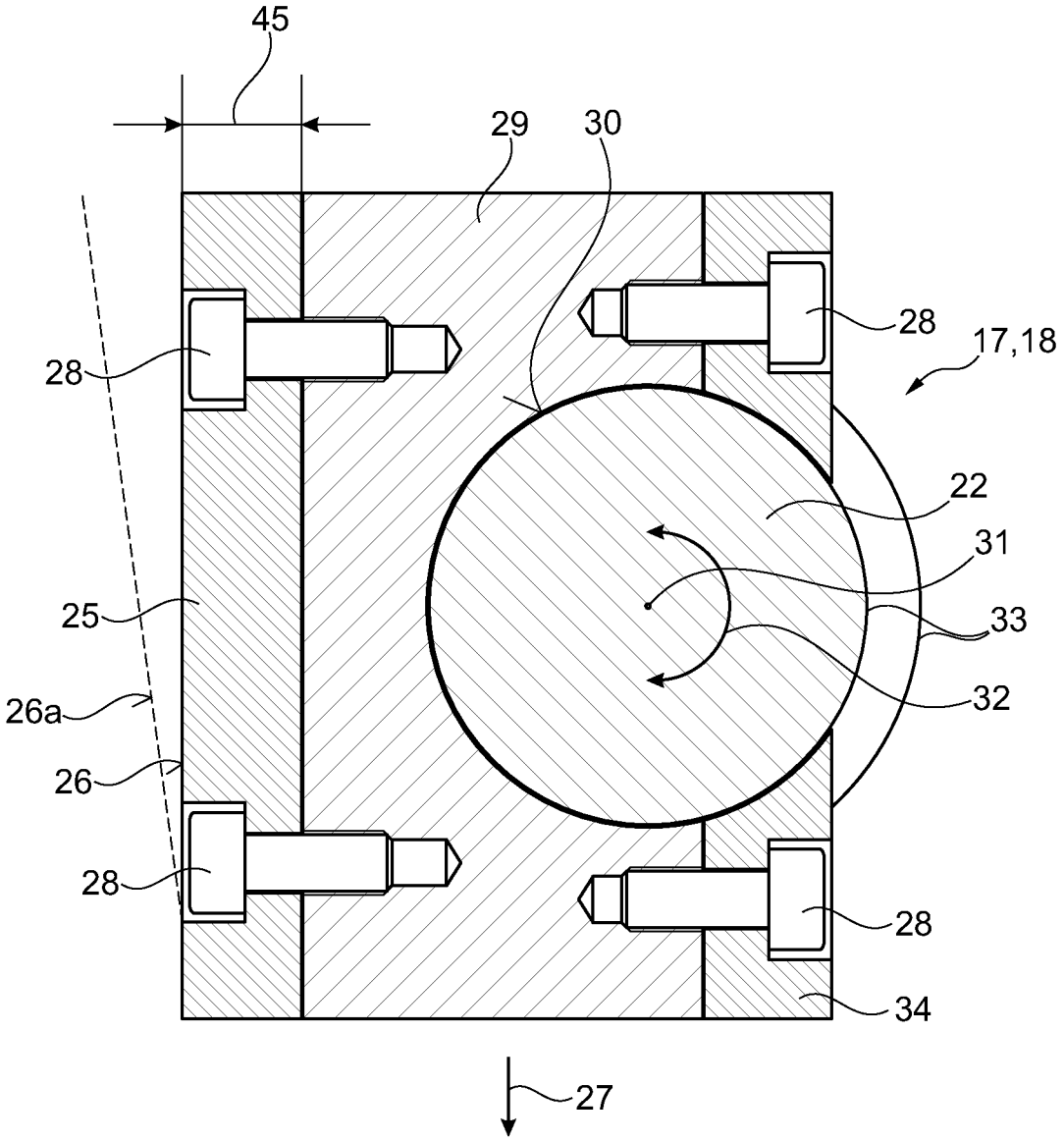

A movable adjustment using a pressure ring, wherein a continuous change of the rolling depth of the profile rollers or the penetration depth of the forming bodies occurs, is described in WO 2009/12 45 34 A2 in FIG. 5 therein, however, this drive principle is not transferable to a roller head or forming head which acts from the inside to the outside.

The invention begins here, which transfers such an adjustment capability to a roller head or forming head, in which the cassettes act on the sheet metal part applied to the external circumference in a manner oriented from the radial inside to the radial outside.

The invention thus also claims the combination of a known roller head according to WO 2009/12 45 34 A2 with a roller head or forming head as will be described hereafter on the basis of FIGS. 1 to 9 of the present invention.

With a further embodiment of the invention, it is provided that a double-walled, pot-shaped sheet metal part is optionally provided with different or identical gear teeth both on the inner wall and also on the outer wall.

For this purpose, in a first processing step, a die or another ring-shaped folder is inserted between the inner wall and the outer wall of the sheet metal part, wherein the die has complementary gear teeth in comparison to the gear teeth rolled on by the profile rollers.

Such gear teeth of the die can optionally only act on the radial outer circumference of the sheet metal part or can only act on the radial inner circumference of the sheet metal part or can act on both circumferences of the sheet metal part with different or identical tooth shapes.

Using such an embodiment, it is accordingly possible for the first time to produce a double-walled sheet metal part, the internal gear teeth of which deviate from the external gear teeth.

The inventive subject matter of the present invention results not only from the subject matter of the individual patent claims, but rather also from the combination of the individual patent claims with one another.

All specifications and features disclosed in the documents of the application, including the abstract, in particular the spatial implementation illustrated in the drawings, are claimed as essential to the invention, insofar as they are novel over the prior art individually or in combination.

The invention will be explained in greater detail hereafter on the basis of drawings which illustrate multiple embodiments. In this case, further features essential to the invention and advantages of the invention result from the drawings and the description thereof.

In the figures:

FIG. 1: shows a section through a forming device in the open state

Figure 2:
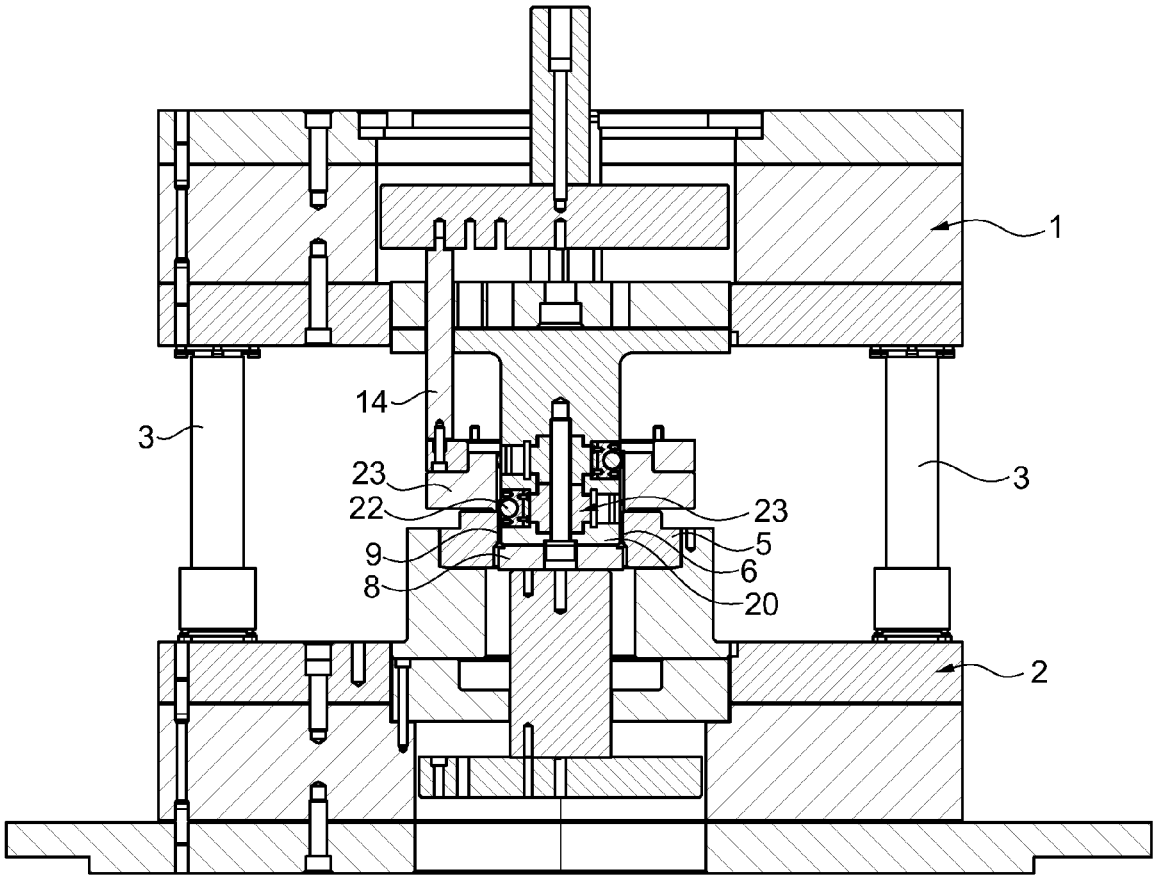
Figure 3:
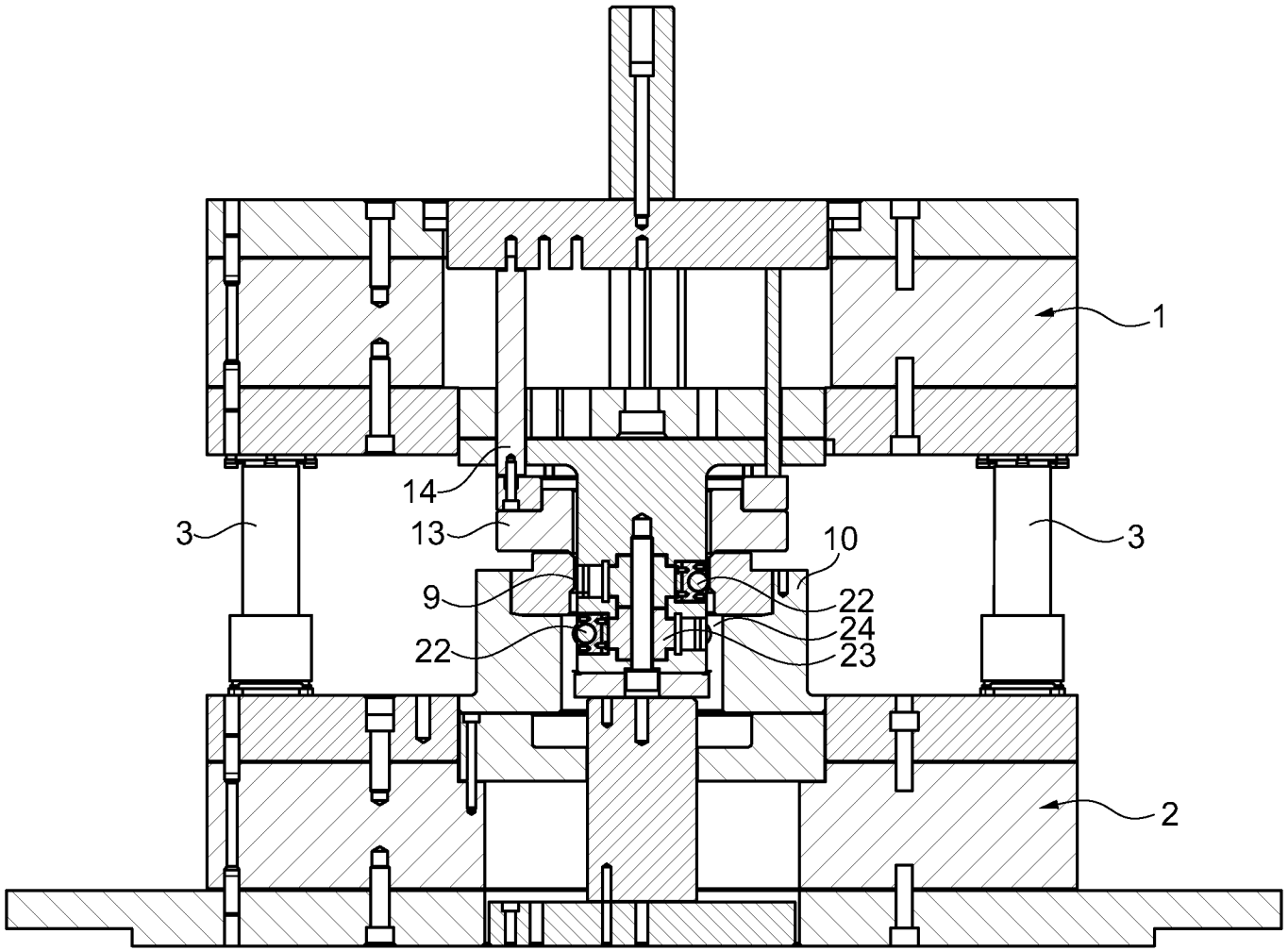
Figure 4:
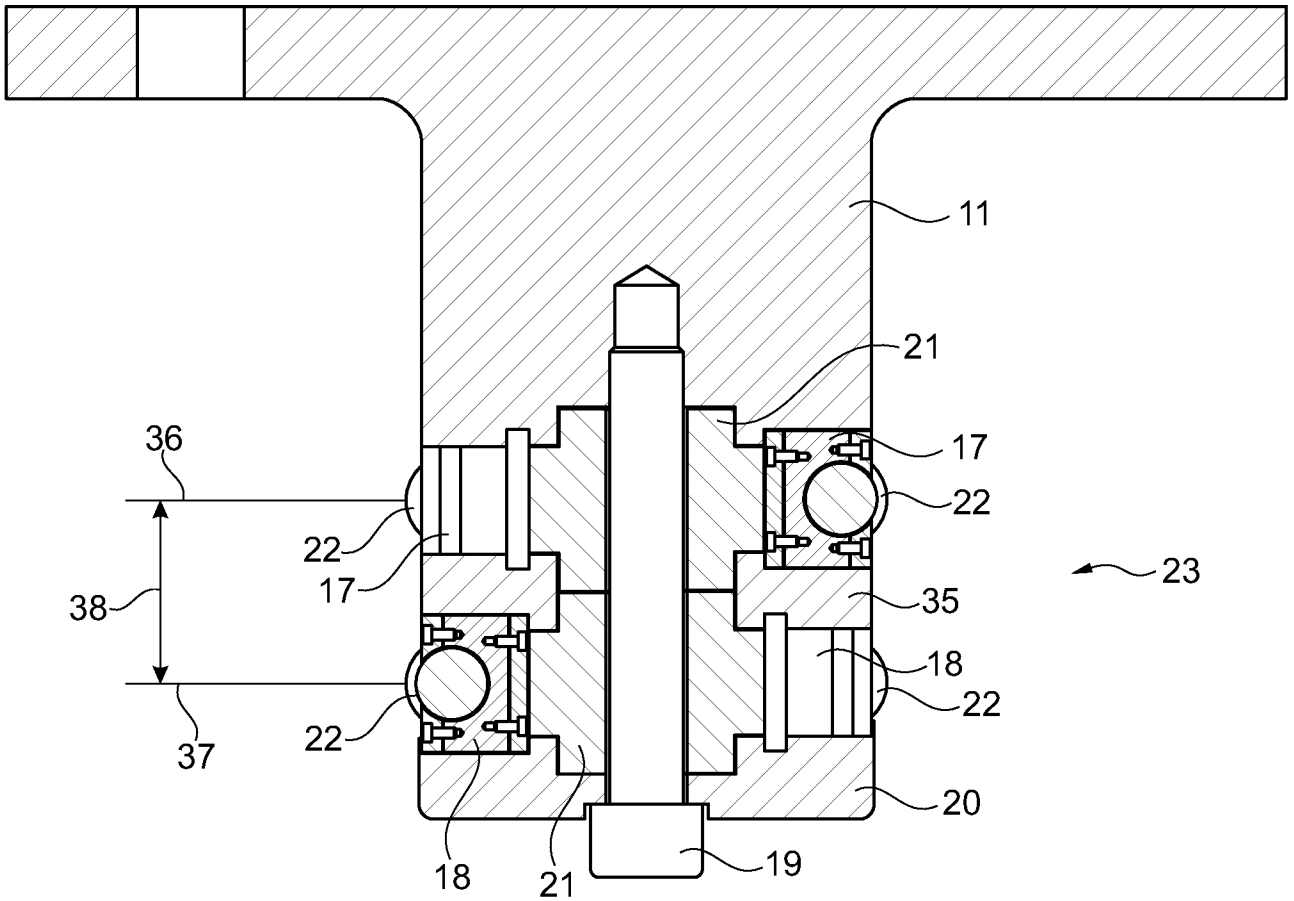
Figure 6:
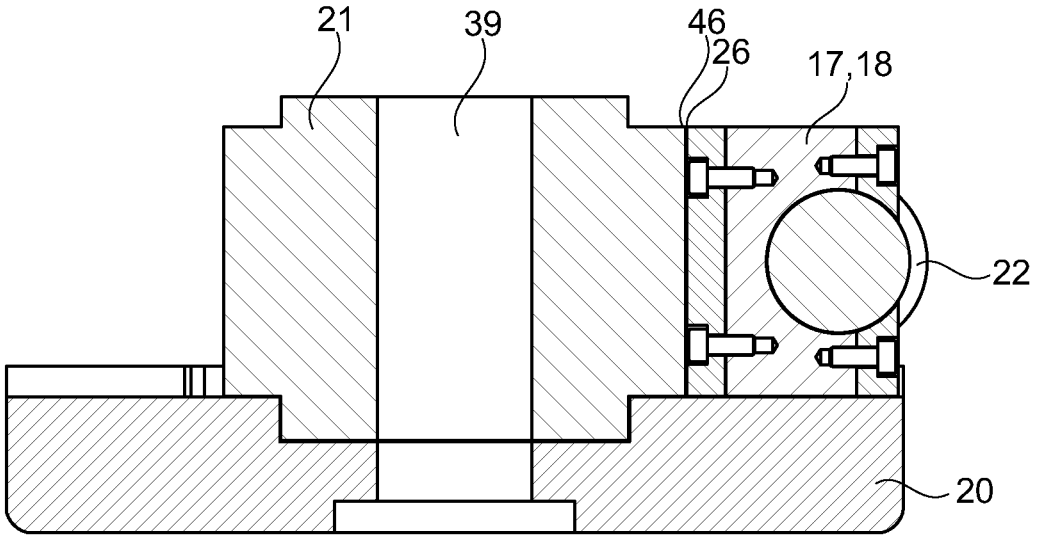

FIG. 2: shows a section through the forming device according to FIG. 1 in the contact position FIG. 3: shows a section through the forming device according to FIGS. 1 and 2 in the closed position FIG. 4: shows an enlarged illustration of the roller head in section FIG. 5: shows a section through a cassette FIG. 6: shows an installation example for a cassette according to FIG. 5

Figure 7:
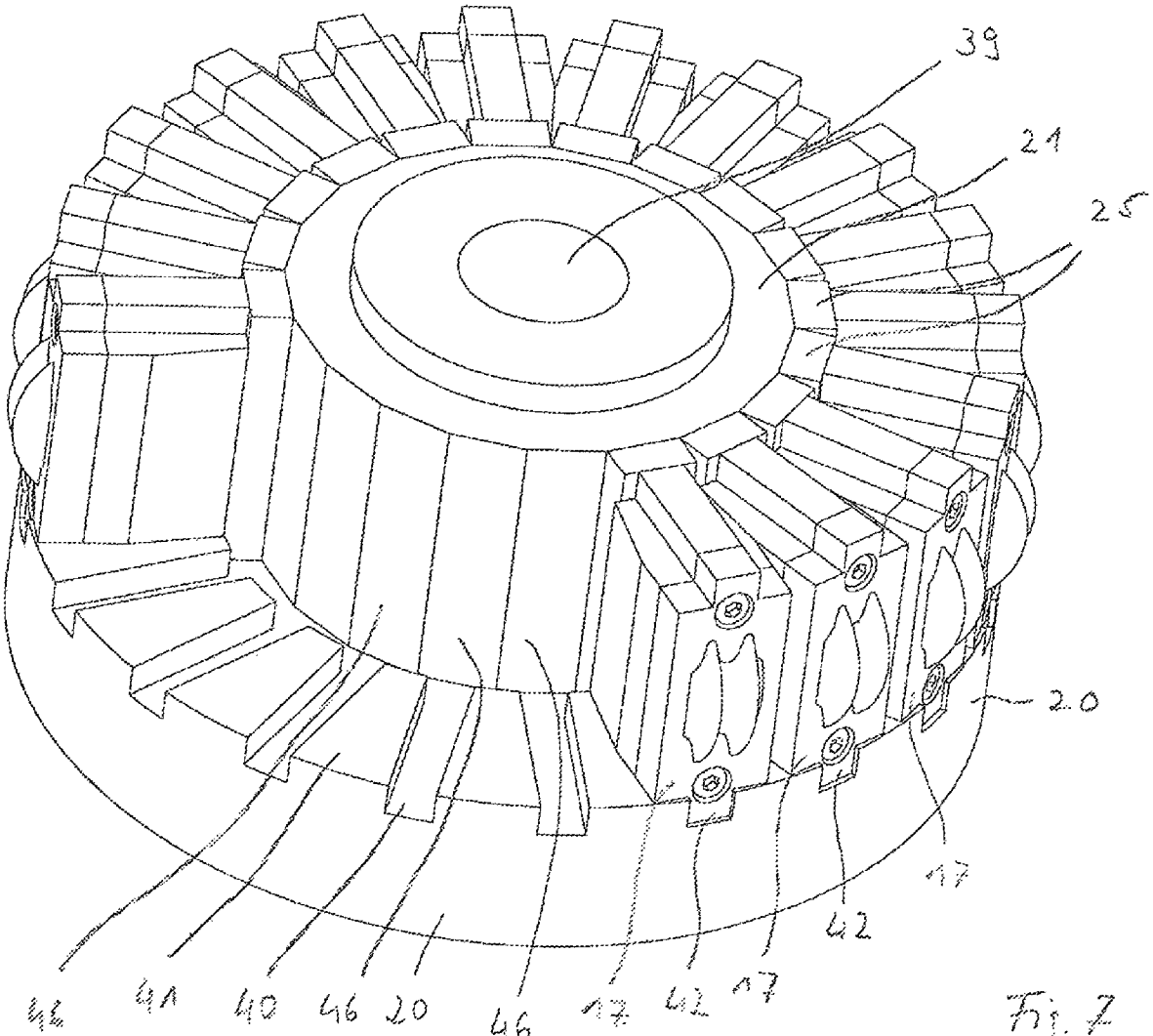
Figure 9:
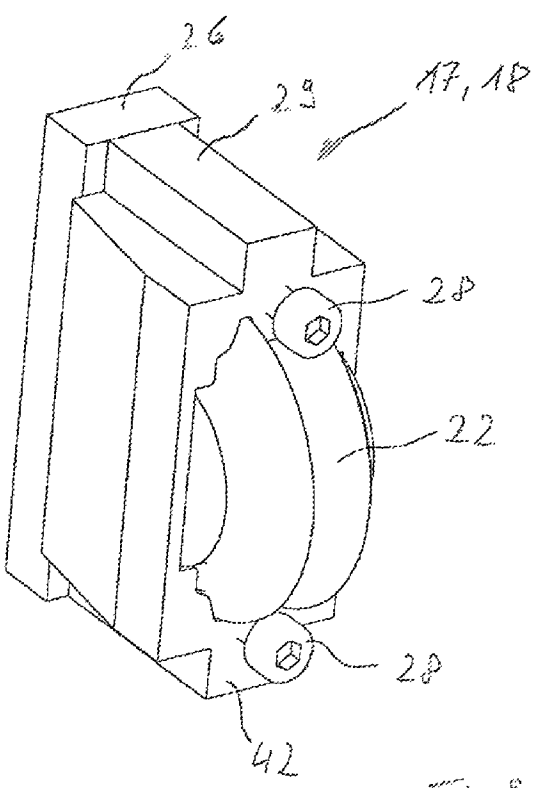
Figure 8:
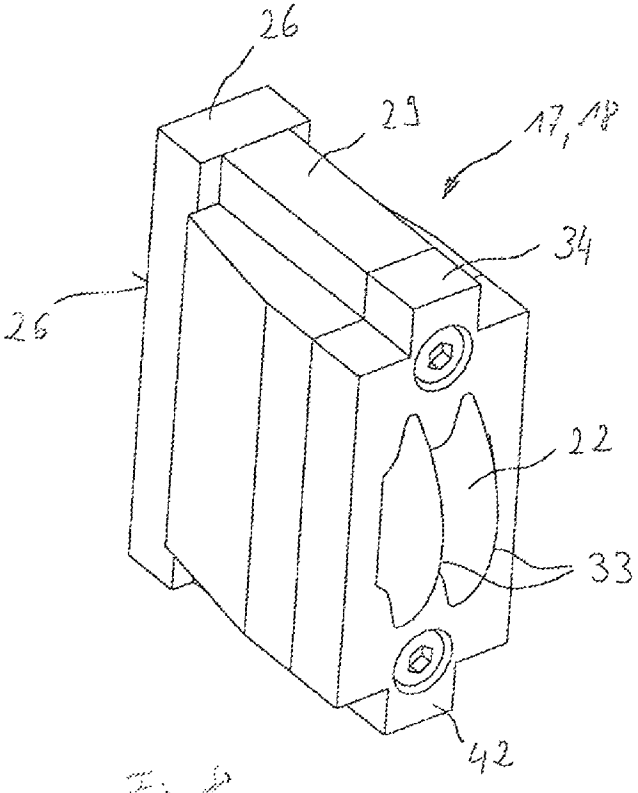
Figures 11A, 11B, 11C:
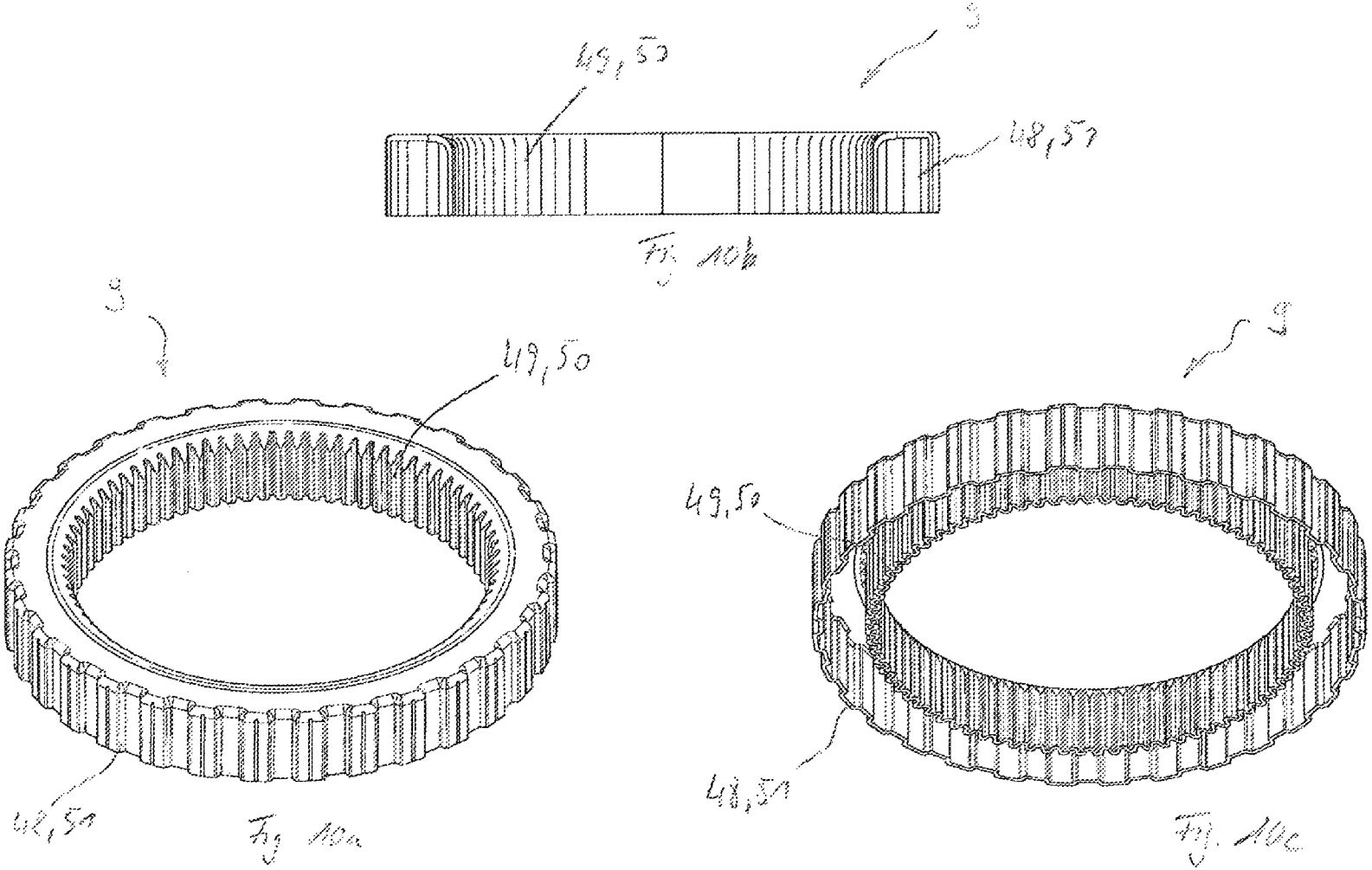

FIG. 7: shows a perspective illustration of the roller head with partially shown cassettes FIG. 8: shows a perspective illustration of a cassette with an installed profile roller FIG. 9: shows the cassette according to FIG. 8, wherein the closure plate was removed FIG. 10*a*: shows a perspective illustration of a double-toothed workpiece FIG. 10*b*: shows a section through the workpiece according to FIG. 10*a*

FIG. 10*c*: shows a perspective bottom view of the workpiece according to FIG. 10*a*

Figure 12:
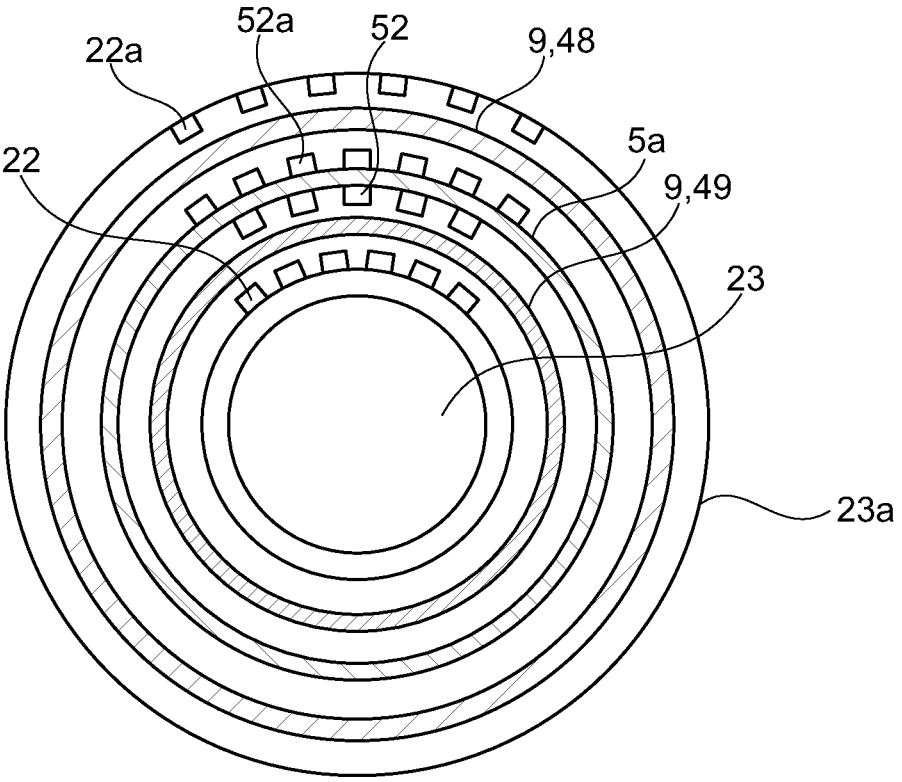
Figure 11:
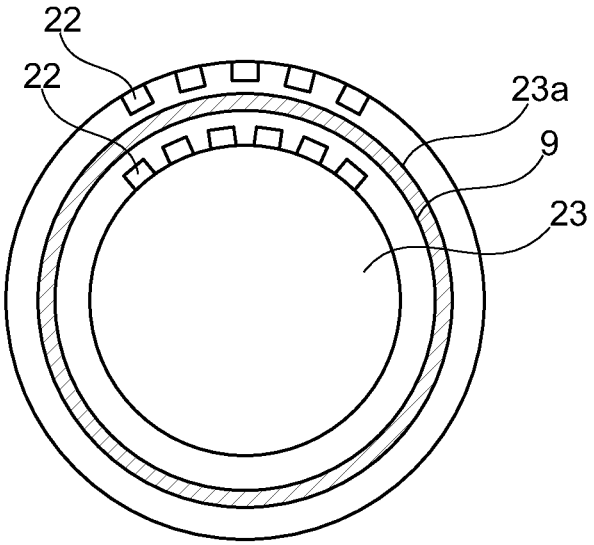
Figure 13:
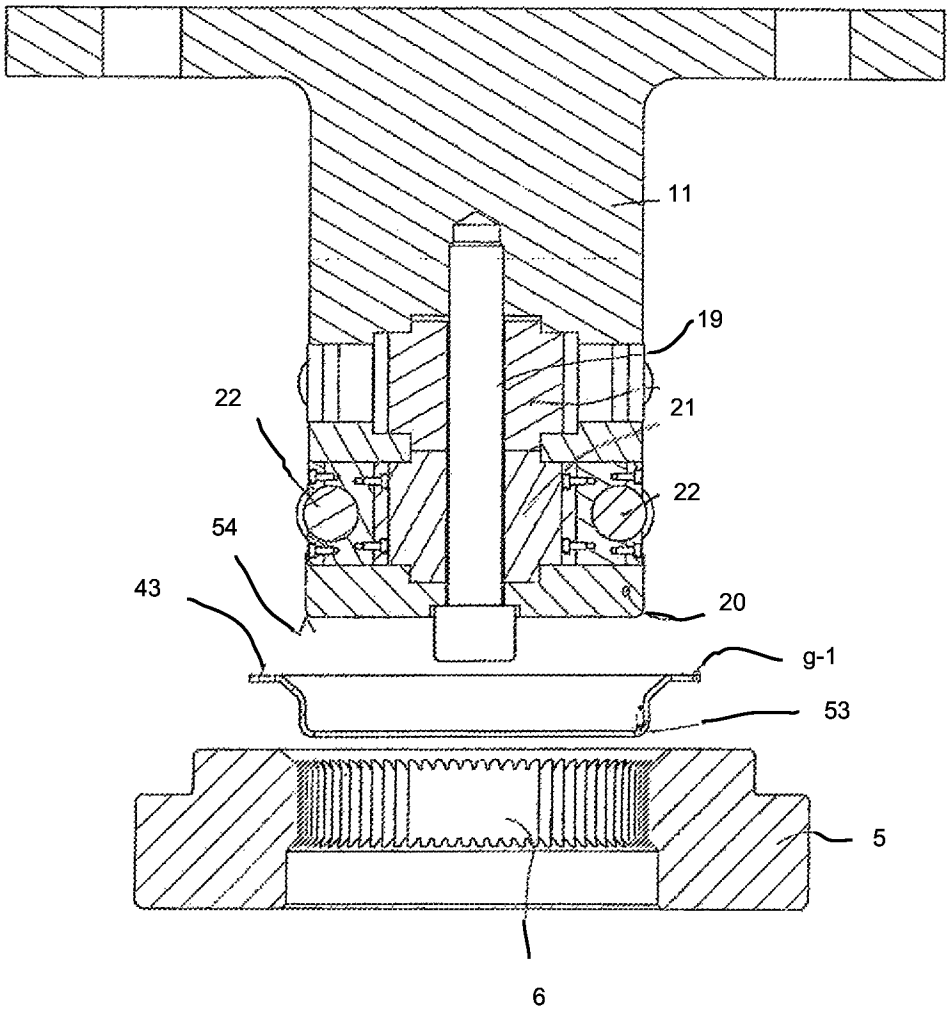

FIG. 11: shows a sectional illustration of the production of a single-walled and double-toothed workpiece FIG. 12: shows a sectional illustration of the production of a double-walled and double-toothed workpiece FIG. 13: shows a sectional illustration of an alternative forming device having a two-step forming tool The forming device according to FIGS. 1 to 3 substantially consists of an upper tool 1 and a lower tool 2 arranged underneath in relation thereto.

A number of downwardly oriented guide columns 3 are provided on the upper tool 1, which plunge into the guide receptacles 4 when the upper tool 1 is lowered in the arrow direction 27 toward the lower tool 2.

In this manner, the upper tool 1 is centered in relation to the lower tool 2.

On the lower tool 2, a recess is arranged in a clamping plate 44, in which a counter holder piston 7 is held so it is movable via further holding plates. The drive of the counter holder piston is not shown in greater detail. It plunges through a ring space 24, which is arranged centrally in the interior of a ring receptacle 10.

A die 5 having associated, inwardly oriented gear teeth 6 is arranged on the ring receptacle 10. The sheet metal part 9, which is not yet formed, is seated on the die 5, wherein internal centering is performed via the forming plate 8. A gap is present between the outer circumference of the forming plate 8 and the inner circumference of the die 5 provided with the gear teeth 6.

In the exemplary embodiment shown, the sheet metal part 9 has an outwardly oriented flange 43, which is equipped with a larger circumference. An application of gear teeth by a forming head (roller head 23), as is described in the prior art, would therefore not be possible.

For this reason, the invention provides that a forming head 23 is provided with forming bodies (profile rollers 22), which are oriented from the inside toward the outside.

According to FIG. 1, the forming head 23 consists of a rotationally-symmetrical holder 11, which is fastened in the upper tool 1 and which is penetrated by a stripping tool. The stripping tool consists of a stripper 14, which is provided with a lower ring plate 13.

Two sets of forming bodies in the implementation of profile rollers 22 are arranged in two working layers 36, 37 lying one above the other (see FIG. 4) in the holder 11, these forming bodies being received in a rotatable and axle-free manner in associated cassettes 17, 18.

Two stop bushings 21 located one above the other are provided, which are connected together by a central fastening screw 19, so that this fastening screw 19 holds together the entire package having the stop bushings 21 and the cassettes 17, 18, which are arranged in two working layers and at a mutual distance to one another.

The lower ring of cassettes 18 is held and guided by a lower indexing plate 20, while the upper ring of cassettes 17 is held and guided by an upper indexing plate 35.

In the functional position shown in FIG. 1, the open location of the upper tool is shown in comparison to the lower tool 2.

In FIG. 2, the same parts are provided with the same reference signs as in FIG. 1. The so-called contact position is recognizable. The contact position is characterized in that now the forming head (roller head 23) is placed on the upper side of the sheet metal part 9 and the profile rollers 22 of the lower ring of cassettes 18 now begin to plunge into the inner circumference of the sheet metal part 9.

FIG. 2 is followed in the next work step by FIG. 3, where it is recognizable that both the profile rollers 22 of the upper cassettes 17 and also the profile rollers 22 of the lower cassettes 18 have now plunged completely through the sheet metal part 9 and the profile rollers 22 of the lower cassettes 18 have already exited back out of the sheet metal part 9 to be formed. This means that the roller head 23 has now plunged into the central ring space 24 of the ring receptacle 10.

In this method step, the stripper 14 would now be seated with its ring plate 13 on the formed sheet metal part 9, which is provided with the internal and external gear teeth, and will hold this part back while the upper tool 1 moves back upward.

The removal of the sheet metal part which is thus formed is then performed according to FIG. 1 by the counter holder piston 7, which moves upward in the opposite direction to the arrow direction 27 and moves out the sheet metal part 9 upward, wherein FIG. 1 shows the position already moved out of the die 5.

FIG. 4 shows an enlarged illustration of the structure of the roller head, wherein it is also indicated in conjunction with FIG. 1 that the roller head 23 is seated on the holder 11 and the holder is in turn received in a holding plate 12 (see FIG. 1). In the region of the holding plate 12 having a base plate 47 located above it, a central recess is provided, in which a crossbeam 15 is arranged, which is driven so it is movable by a pressure bolt 16 and which drives the stripper 14 with its ring plate 13 so it is displaceable.

FIG. 4 therefore only shows the holder 11, while the remaining parts above the holder were described on the basis of FIG. 1.

Two different working positions 36, 37 are provided, which assume a mutual distance 38 from one another, wherein a ring of cassettes 17, 18 arranged distributed uniformly on the circumference is provided on each working position 36, 37.

The number of the cassettes 17, 18, which are arranged uniformly distributed on the respective circumference of the working positions 36 and 37, is dependent on the fineness and the indexing of the desired gear teeth in the sheet metal part 9.

It is important in any case that each collar of cassettes 17, 18 is formed by an internal stop bushing 21, against the internal circumference and outwardly oriented circumference of which the respective back plates of the cassettes 17, 18 press. In this manner, the forming pressure which acts from the profile rollers 22 on the cassettes 17, 18 is transmitted via the cassette housing to the back plate and from there to the external circumference of the respective stop bushing 21.

For this reason, the stop bushings 21 can be installed in a space-saving manner and absorb the entire forming load, whereby the small structure circumference of the roller head 23 results.

The entire package of the lower indexing plate 20, the stop bushing 21 located in between, the upper indexing plate 35, and the upper stop bushing 21 is held together by the central fastening screw 19.

FIG. 5 shows a first embodiment of a cassette 17, 18 for the roller head 23. The cassette is also illustrated in perspective on the basis of FIGS. 8 and 9.

It substantially consists of a back plate 25, which is provided in the exemplary embodiment shown at a uniform thickness 45, which extends over the entire height of the cassette 17, 18.

The back plate 25 is screwed together by means of fastening screws 28 with the housing 29 of the cassette.

The front side of the cassette is formed by a closure plate 34, in which a front recess is provided, by which the profile of the axle-free profile roller 22, which is mounted so it is rotatable in the interior of the cassette, is received.

Accordingly, a bearing surface 30, which encloses the outer circumference of the profile roller 22 and receives it in a formfitting manner, is provided in the interior of the cassette 17, 18. Lubricating grooves or other bearings (not shown in greater detail) can be provided.

It can also be provided that the profile roller 22 is not received in an axle-free manner in the bearing surface of the recess in the interior of the cassette 17, 18, but rather that in this region the profile roller 22 is rotatably mounted with an axis in the cassette. It is also mounted so it is rotatable in the receptacle in the two arrow directions 32, and therefore on the bearing surface 30.

In a third embodiment of the invention, it can be provided that instead of a profiled profile roller (an example of a profile is shown in FIGS. 8 and 9), a non-profiled profile roller is also provided. In a third embodiment, it can be provided that instead of the profile roller, an axle-free mounted ball or a rolling body (for example, a cylindrical rolling body) is provided, which rolls in a formfitting manner in the bearing surface 30.

The receptacle in the cassette with the bearing surface 30 is selected in any case so that when the closure plate 34 is removed by loosening the fastening screws 28, the profile roller 22 can be removed and replaced.

The rotational axis 31 is therefore only shown schematically, because it is an axle-free mounted profile roller 22.

As described above, however, the profile roller 22 can also be received with a stub axle in the rotational axis 31 so it is rotatable in the cassettes 17, 18.

FIG. 5 shows that a step-by-step adjustment of the forming depth can be performed in that the back plate 25 is provided as replaceable and, for example, can be replaced with a back plate 25 of greater thickness. In this case, if the thickness 45 of the back plate is increased, the forming depth of the profile roller 22 in the sheet metal part 9 is also increased.

In another embodiment according to FIG. 5, which is shown with dashed lines, it can also be provided that the back plate 25 with its guide surface 26 is not applied in parallel to the movement direction in the arrow direction 27, but rather that this guide surface **26*a* is conical in the direction in relation to the working direction 27 of the cassette. This is symbolized by the guide surface 26*a*. In this case, during the movement of the cassette with the conically beveled guide surface 26*a*, a continuous change of the forming depth of the profile roller 22 would take place during the work stroke in the arrow direction 27**.

FIG. 6 shows, as an installation example, a cassette according to FIG. 5, as it presses with its guide surface 26 or **26*a* on a guide surface 46 oriented in the same direction (see FIG. 7**).

The guide surface 46 is formed in this case on the outer circumference of the respective stop bushing 21.

FIG. 7 shows such an installation example, where it is recognizable that the rotationally-symmetrical stop bushing 21 is provided on the outer circumference with a plurality of stepped guide surfaces 46, on each of which the associated guide surfaces 26 are arranged in the region of the back plates 25 of the cassettes 17, 18.

For securing in location, guide attachments 42 are formed on the base sides of the respective cassette, which are aligned in the radial direction and are guided so they are displaceable in associated radial grooves 40 of the indexing plate 20.

In this manner, the cassettes 17, 18 are held so they are easily replaceable, on the one hand, on the base surface of the indexing plate 20 and, on the other hand, with their internal circumference on the external circumference of the stop bushing 21.

FIGS. 8 and 9 show perspective views of the structure in each case of a cassettes 17 or 18. The same reference signs are used for the same parts according to FIG. 5.

In FIG. 9, the closure plate 34 is removed in comparison to FIG. 8 solely for illustration. The profile rollers 22 are provided with arbitrary profile edges 33.

The type of the profile edges is oriented according to the type of the desired gear teeth.

FIG. 11 shows the combination example of a novel double roller head 23, **23*a* which substantially consists of a roller head 23 according to the above drawings and furthermore of a roller head 23*a***, as is described in principle in WO 2009/12 45 34 A2.

The combination of two roller heads 23, **23*a*, of which one forming set operates from the inside to the outside in the roller head 23 and the other forming set operates from the outside to the inside in the roller head 23*a***, is heretofore not known from the prior art, however.

Using this novel profile combination roller head 23, **23*a*, it is now possible for the first time to apply first gear teeth 51 on the outer circumference of a sheet metal part 9 and to apply second gear teeth 50** on the inner circumference of the same sheet metal part.

It is not necessary for the solution in this case for the two roller heads 23, **23*a* to operate on the same plane; they can also, as a sequential tool, for example, first form the sheet metal part 9** oriented from the inside to the outside following one another in succession and in the second forming step then form the sheet metal part, which has already been formed from the inside to the outside, also subsequently from the outside to the inside.

In a further embodiment, using the combination of the two roller heads 23, 23*a*, it is possible for the first time to provide a double-walled pot-shaped sheet metal part 9 on both coaxial circumferences 48, 49 with gear teeth 50, 51.

Such a double-walled sheet metal part 9 is visible in FIGS. 10*a-c*, wherein the outer circumference 48 has gear teeth 51 and the inner circumference 49 has gear teeth 49. The gear teeth 51 were applied in this case by the roller head 23*a* and the gear teeth 49 were applied by the roller head 23

For this purpose, as shown in FIG. 12, in one processing step a die 5*a* or another ring-shaped holder was inserted between the inner circumference 49 and the outer circumference 48 of the sheet metal part 9, wherein the profile rollers 23*a*, which are oriented radially from the outside toward the inside, apply first gear teeth 51 on the outer circumference 48 of the sheet metal part 9 and the die 5*a*, which presses against the inner circumference of the outer circumference 48, has complementary gear teeth 52*a*. The roller head 23*a* acts in this case with the profile rollers 22*a* on the outer circumference 48.

In a similar manner, the profile rollers 22, which are oriented radially from the inside toward the outside, manufacture gear teeth 50 on the inner circumference 49 of the inner ring of the sheet metal part 9. The associated die 5*a* also has gear teeth 52 complementary to the gear teeth 50 here.

The die 5*a* can also be a uniform ring-shaped part, which has the complementary gear teeth 52*a* on the outer circumference, and the complementary gear teeth 52 on the inner circumference. In this embodiment, the gear teeth 50, 51 can be produced on the double-walled workpiece 9 in a single work operation FIG. 13 shows an alternative embodiment to FIG. 1, which is characterized in that a deep-drawing tool leads the roll forming tool.

The deep-drawing tool according to FIG. 13 substantially consists of the indexing plate 20, on the bottom side of which a forming edge 54 is implemented. To form the sheet metal part 9-1 shown in FIG. 13, firstly the indexing plate 20 is lowered into the inner cross-section of the sheet metal part 9-1, whereby the forming edge 54 is applied in a forming manner to the inner collar 53 of the approximately pot-shaped sheet metal part 9-1 and firstly cylindrically forms this collar 53. The indexing plate 20 with its forming edge 54 corresponds in function to a deep-drawing tool. Only after completed pressure forming using the deep-drawing tool does the roll forming tool follow with its profile rollers 22, which then ensure the gear teeth on the inner and/or outer circumference of the sheet metal part 9-1.

This exemplary embodiment, in which a deep-drawing tool having a leading forming edge 54 firstly plunges into the internal circumference of the sheet metal part 9-1, can be used for all above-described embodiments.

LIST OF REFERENCE SIGNS

1 upper tool
2 lower tool
3 guide column
4 guide receptacle
5 die 5*a*
6 gear teeth (of 5)
7 counter holder piston
8 forming plate
9 sheet metal part
9-1 sheet metal part
10 ring receptacle
11 holder
12 holding plate
13 ring plate (stripper 14)
14 stripper
15 crossbeam
16 pressure bolt
17 cassette
18 cassette
19 fastening screw
20 indexing plate
21 stop bushing
22 forming body or profile roller
22*a* forming body or profile roller
23 forming body or roller head
23*a* forming body or roller head
24 ring space
25 back plate
26 guide surface 26*a* (of 17, 18)
27 arrow direction
28 screw
29 housing
30 bearing surface
31 rotational axis
32 arrow direction
33 profile edge
34 closure plate
35 indexing plate
36 working positions
37 working positions
38 distance
39 longitudinal bore hole (for 19)
40 radial groove
41 support
42 guide attachment
43 flange (of 9)
44 clamping plate
45 thickness (of 25)
46 guide surface (of 21)
47 base plate (of 1)
48 outer circumference
49 inner circumference
50 inner gear teeth
51 outer gear teeth
52 complementary gear teeth
52*a* (of 5*a*)
53 collar (inner side of 9)
54 forming edge (on 20)

The invention claimed is:

1. A method using a forming device for producing a toothed pot-shaped sheet metal part having teeth extending toward a pot central axis, comprising:

inserting a pot-shaped sheet metal part into a die, the pot-shaped sheet metal part having a medial plane, and wherein the pot center axis extends perpendicular to the medial plane, then, by relative movement between the pot-shaped sheet metal part and a first forming head comprising first forming bodies on an outer circumference thereof, performing a forming operation by rolling a profile onto the pot-shaped sheet metal part by the first forming bodies applied to the pot-shaped sheet metal part to apply alternating internal and external gear teeth to the pot-shaped sheet metal part, radially from an inside area toward an outside periphery of the sheet metal part, and wherein the first forming bodies roll along an inner circumference of the pot-shaped sheet metal part in a direction parallel to the pot central axis and perpendicular to the medial plane of the pot-shaped sheet metal part, and completely move through the pot-shaped sheet metal part so that the first forming bodies exit back out of the pot-shaped sheet metal part thereby forming the toothed pot-shaped sheet metal part.

2. The method according to claim 1, wherein a stripper, which is movable separately from the forming head, is arranged on an upper tool of the forming device, and the method further comprises ejecting the pot-shaped sheet metal part, by the stripper, after the forming operation, and holding the pot-shaped sheet metal part in place by a ring plate when the upper tool is moved upward.

3. The method according to claim 1, wherein the first forming bodies are adjustable and fixable in cassette-shaped receptacles by path displacement radially in relation to gear teeth in the die.

4. The method according to claim 1, wherein the first forming bodies are radially adjustable during the forming operation.

5. The method according to claim 1, wherein a second forming head having cassettes acts oriented from the outside toward the inside on the pot-shaped sheet metal part, the second forming head comprising second forming bodies are oriented radially inward on an outer circumference of the pot-shaped sheet metal part.

6. A method using a forming device for producing a toothed pot-shaped sheet metal part having teeth extending toward a pot central axis, comprising:

inserting a pot-shaped sheet metal part into a die, then, by relative movement between the pot-shaped sheet metal part and a first forming head comprising first forming bodies on an outer circumference thereof, performing a forming operation by rolling a profile onto the pot-shaped sheet metal part by the first forming bodies applied to the pot-shaped sheet metal part to apply alternating internal and external gear teeth to the pot-shaped sheet metal part, radially from an inside area toward an outside periphery of the sheet metal part, and wherein the first forming bodies roll along an inner circumference of the pot-shaped sheet metal part in a direction of the pot central axis, and completely move through the pot-shaped sheet metal part so that the first forming bodies exit back out of the pot-shaped sheet metal part thereby forming the toothed pot-shaped sheet metal part, wherein a second forming head having cassettes acts oriented from the outside toward the inside on the pot-shaped sheet metal part, the second forming head comprising second forming bodies are oriented radially inward on an outer circumference of the pot-shaped sheet metal part, and wherein, introducing, a ring-shaped die between an outer circumference and an inner circumference of the pot-shaped sheet metal part to produce a double-walled pot-shaped sheet metal part, to roll gear teeth onto the outer circumference and gear teeth onto the inner circumference of the pot-shaped sheet metal part while using a combination of the first and second forming heads.

7. A device for producing a toothed pot-shaped sheet metal part having teeth extending toward a pot center axis, comprising:

a die into which an un-toothed pot-shaped sheet metal part is inserted, and forming bodies configured to be applied to the un-toothed pot-shaped sheet metal part by a relative movement between the un-toothed sheet metal part and a forming head provided with the forming bodies on an outer circumference thereof, the forming bodies being arranged and oriented radially outside on the forming head to roll along an inner circumference of the un-toothed pot-shaped sheet metal part in a direction parallel to the pot center axis, and configure to create alternating internal and external gear teeth on the un-toothed pot-shaped sheet metal part, the forming bodies being configured to completely pass through the un-toothed pot-shaped sheet metal part so that the forming bodies exit from the un-toothed pot-shaped sheet metal part to form the toothed pot-shaped sheet metal part, and a pressure ring or another pressure element to form gear teeth on the un-toothed pot-shaped sheet metal part, the gear teeth being conical in a longitudinal direct and configured to exert a pressure oriented in an axial direction on cassettes containing the forming bodies during a downward stroke of the forming device, wherein the cassettes comprise conically beveled back plates configured to move radially inward on conically beveled guide surfaces of a stop bushing to provide a continuous and/or step-by-step adjustment of a radial forming depth of the cassettes.

8. A device for producing a toothed pot-shaped sheet metal part having teeth extending toward a pot center axis, comprising:

a die into which an un-toothed pot-shaped sheet metal part is inserted, and forming bodies configured to be applied to the un-toothed pot-shaped sheet metal part by a relative movement between the un-toothed sheet metal part and a forming head provided with the forming bodies on an outer circumference thereof, the forming bodies being arranged and oriented radially outside on the forming head to roll along an inner circumference of the un-toothed pot-shaped sheet metal part in a direction parallel to the pot center axis, and configure to create alternating internal and external gear teeth on the un-toothed pot-shaped sheet metal part, the forming bodies being configured to completely pass through the un-toothed pot-shaped sheet metal part so that the forming bodies exit from the un-toothed pot-shaped sheet metal part to form the toothed pot-shaped sheet metal part, and a first collar of cassettes arranged on the forming head, and at least a second collar of cassettes arranged above the first collar on the forming head.

9. The device according to claim 7, wherein each cassette has a back plate, which is replaceable and which is configured to enable a radial adjustment of the cassette in a radial direction on the un-toothed pot-shaped sheet metal part depending on a thickness of the back plate.

10. The device according to claim 9, wherein each of the back plates of the cassettes are applied to cylindrical guide surfaces, which are aligned in parallel to a movement direction of the forming head, on the stop bushing.

11. The device according to claim 7, wherein the forming bodies are implemented as axle-free mounted profile rollers or as pressure parts or as balls or as pins, rollers, or other rotatable bodies and at least one forming body is mounted in each cassette.

12. The device according to claim 7, the forming bodies are mounted on axes in the cassette.

13. The device according to claim 7, wherein a first set of forming bodies are provided and oriented radially from an inside area to an outside area for forming an inner circumference of the toothed pot-shaped sheet metal part, the first set of forming bodies are configured to roll along the inner circumference of the un-toothed pot-shaped sheet metal part in a direction parallel to the pot center axis, and a second set of forming bodies being provided and oriented radially from the outside are toward the inside area for forming an outer circumference of the toothed pot-shaped sheet metal part.

14. The device according to claim 7, further comprising a deep-drawing tool, which leads the forming bodies.

15. The device according to claim 8, wherein each cassette has a back plate, which is replaceable and which is configured to enable a radial adjustment of the cassette in a radial direction on the un-toothed pot-shaped sheet metal part depending on a thickness of the back plate.

16. The device according to claim 15, wherein each of the back plates of the cassettes are applied to cylindrical guide surfaces, which are aligned in parallel to a movement direction of the forming head, on the stop bushing.

* * * * *